US009201437B2

(12) United States Patent
Chang et al.

(10) Patent No.: US 9,201,437 B2
(45) Date of Patent: Dec. 1, 2015

(54) MULTI-INPUT LOW DROPOUT REGULATOR

(71) Applicant: Etron Technology, Inc., Hsinchu (TW)

(72) Inventors: Yen-An Chang, Miaoli County (TW); Yi-Hao Chang, Hsinchu (TW)

(73) Assignee: Etron Technology, Inc., Hsinchu (TW)

( * ) Notice: Subject to any disclaimer, the term of this patent is extended or adjusted under 35 U.S.C. 154(b) by 87 days.

(21) Appl. No.: 14/100,009

(22) Filed: Dec. 8, 2013

(65) Prior Publication Data

US 2014/0210438 A1 Jul. 31, 2014

(30) Foreign Application Priority Data

Jan. 25, 2013 (TW) ..... 102102909

(51) Int. Cl.
*G05F 1/56* (2006.01)
*G05F 3/02* (2006.01)
*G05F 1/00* (2006.01)

(52) U.S. Cl.
CPC .. *G05F 1/56* (2013.01); *G05F 1/00* (2013.01); *G05F 3/02* (2013.01)

(58) Field of Classification Search
CPC ..... G05F 1/56
USPC ..... 323/273, 275, 279; 365/226, 189.09, 365/227, 228; 327/535
See application file for complete search history.

(56) References Cited

U.S. PATENT DOCUMENTS

2007/0216381 A1* 9/2007 Tsuchiya et al. ..... 323/273
2009/0147594 A1* 6/2009 Chou et al. ..... 365/189.09

FOREIGN PATENT DOCUMENTS

TW 201234027 8/2012

* cited by examiner

*Primary Examiner* — Jeffrey Gblende
*Assistant Examiner* — Trinh Dang
(74) *Attorney, Agent, or Firm* — Winston Hsu; Scott Margo

(57) ABSTRACT

A multi-input low dropout regulator includes an amplifier, a first metal-oxide-semiconductor transistor, and a resistor. The amplifier has a plurality of first input terminals, a second input terminal, and an output terminal. Each first input terminal of the plurality of first input terminals is used for receiving an internal voltage. The first metal-oxide-semiconductor transistor has a first terminal for receiving a first voltage, a second terminal coupled to the output terminal of the amplifier, and a third terminal coupled the second input terminal of the amplifier. The resistor has a first terminal coupled to the third terminal of the first metal-oxide-semiconductor transistor, and a second terminal for receiving a second voltage. The third terminal of the first metal-oxide-semiconductor transistor is further used for coupling to a monitor pad, and the monitor pad is used for outputting the internal voltage.

14 Claims, 4 Drawing Sheets

MULTI-INPUT LOW DROPOUT REGULATOR

BACKGROUND OF THE INVENTION

1. Field of the Invention

The present invention relates to a multi-input low dropout regulator, and particularly to a multi-input low dropout regulator that can utilize an amplifier with a plurality of first input terminals and one monitor pad to monitor a plurality of internal voltages of an integrated circuit.

2. Description of the Prior Art

In the prior art, in order to measure an internal voltage of an integrated circuit, a designer needs to utilize one operational amplifier and one pad to measure the internal voltage of the integrated circuit.

However, because the designer may measure a plurality of internal voltages within the integrated circuit, the integrated circuit may include a plurality of corresponding operational amplifiers and a plurality of corresponding pads. Thus, the plurality of operational amplifiers and the plurality of pads will significantly increase a chip area of the integrated circuit.

SUMMARY OF THE INVENTION

An embodiment provides a multi-input low dropout regulator. The multi-input low dropout regulator includes an amplifier, a first metal-oxide-semiconductor transistor, and a resistor. The amplifier has a plurality of first input terminals, a second input terminal, and an output terminal, where each first input terminal of the plurality of first input terminals is used for receiving an internal voltage. The first metal-oxide-semiconductor transistor has a first terminal for receiving a first voltage, a second terminal coupled to the output terminal of the amplifier, and a third terminal coupled to the second input terminal of the amplifier. The resistor has a first terminal coupled to the third terminal of the first metal-oxide-semiconductor transistor, and a second terminal is used for receiving a second voltage. The third terminal of the first metal-oxide-semiconductor transistor is further used for coupling to a monitor pad, and the monitor pad is used for outputting the internal voltage.

Another embodiment provides a multi-input low dropout regulator. The multi-input low dropout regulator includes an amplifier, a first metal-oxide-semiconductor transistor, and a resistor. The amplifier has a plurality of first input terminals, a plurality of first enable input terminals, a second input terminal, a second enable input terminal, and an output terminal, where each first input terminal of the plurality of first input terminals is used for receiving an internal voltage. The first metal-oxide-semiconductor transistor has a first terminal for receiving a first voltage, a second terminal coupled to the output terminal of the amplifier, and a third terminal coupled to the second input terminal of the amplifier. The resistor has a first terminal coupled to the third terminal of the first metal-oxide-semiconductor transistor, and a second terminal is used for receiving a second voltage. The third terminal of the first metal-oxide-semiconductor transistor is further used for coupling to a monitor pad, and the monitor pad is used for outputting the internal voltage.

The present invention provides a multi-input low dropout regulator. The multi-input low dropout regulator utilizes an amplifier with a plurality of first input terminals and one monitor pad to monitor a plurality of internal voltage of an integrated circuit. Thus, compared to the prior art, because the present invention utilizes the amplifier and the monitor pad to monitor the plurality of internal voltage of the integrated circuit, the present invention can significantly reduce a chip area of the integrated circuit.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
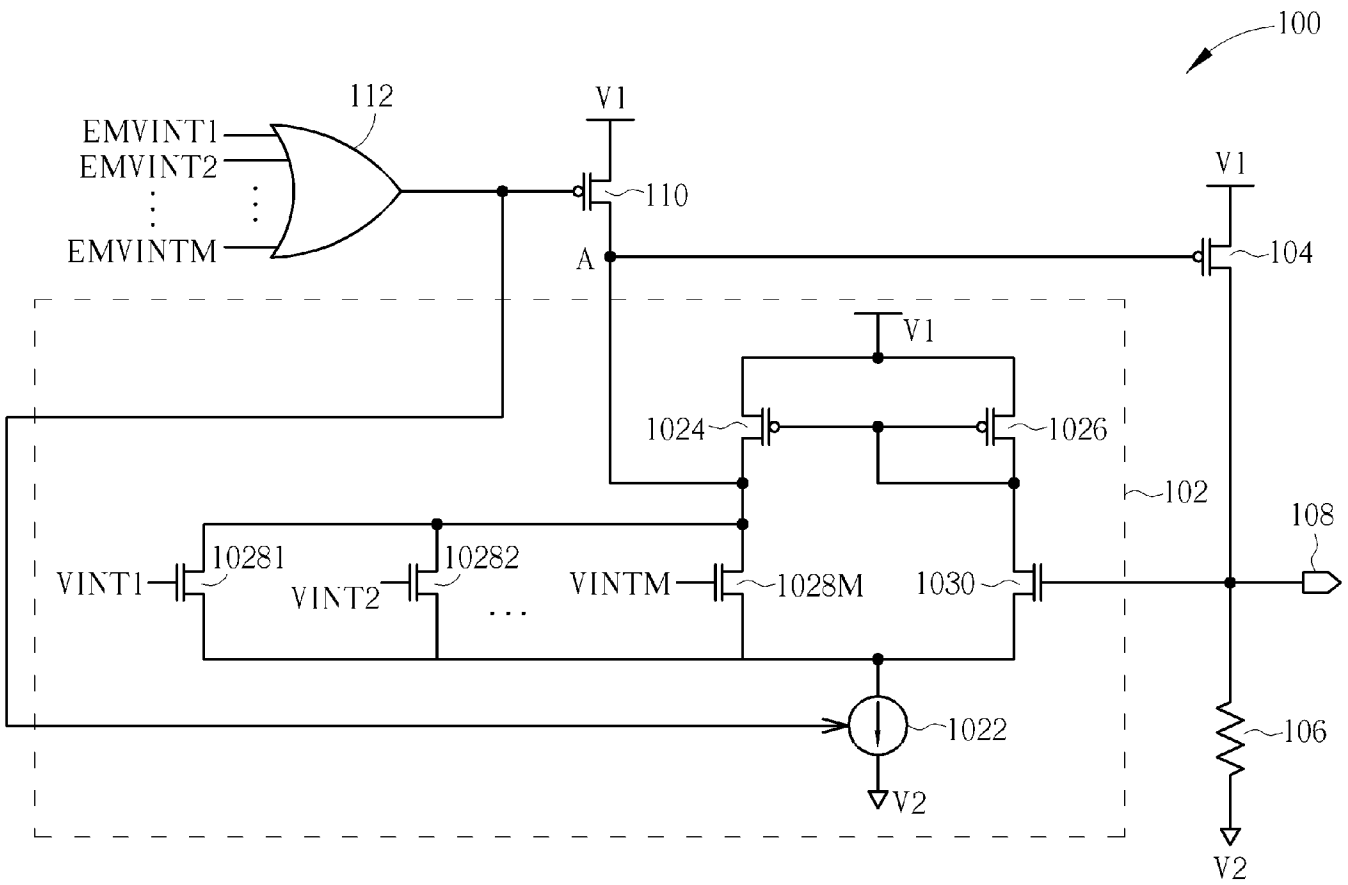
FIG. 1 is a diagram illustrating a multi-input low dropout regulator according to an embodiment.

Please refer to FIG. 1. FIG. 1 is a diagram illustrating a multi-input low dropout regulator 100 according to an embodiment. The multi-input low dropout regulator 100 includes an amplifier 102, a first metal-oxide-semiconductor transistor 104, and a resistor 106, where the first metal-oxide-semiconductor transistor 104 is a P-type metal-oxide-semiconductor transistor. As shown in FIG. 1, the amplifier 102 includes a current source 1022, a first P-type metal-oxide-semiconductor transistor 1024, a second P-type metal-oxide-semiconductor transistor 1026, M first N-type metal-oxide-semiconductor transistors 10281-1028M, and a second N-type metal-oxide-semiconductor transistor 1030, where M is a positive integer. The first metal-oxide-semiconductor transistor 104 has a first terminal for receiving a first voltage V1, a second terminal coupled to a third terminal of the first P-type metal-oxide-semiconductor transistor 1024, and a third terminal coupled to a second terminal of the second N-type metal-oxide-semiconductor transistor 1030, where the first voltage V1 is a high voltage. The resistor 106 has a first terminal coupled to the third terminal of the first metal-oxide-semiconductor transistor 104, and a second terminal for receiving a second voltage V2, where the second voltage V2 is a low voltage. In addition, the third terminal of the first metal-oxide-semiconductor transistor 104 is further used for coupling to a monitor pad 108, and the monitor pad 108 is used for outputting an internal voltage. Therefore, a user can measure the internal voltage outputted by the monitor pad 108 through the monitor pad 108.

As shown in FIG. 1, the current source 1022 has a first terminal, a control terminal, and a third terminal for receiving the second voltage V2. The first P-type metal-oxide-semiconductor transistor 1024 has a first terminal for receiving the first voltage V1, a second terminal, and a third terminal coupled to the second terminal of the first metal-oxide-semiconductor transistor 104, where the third terminal of the first P-type metal-oxide-semiconductor transistor 1024 is used for acting as an output terminal of the amplifier 102. The second P-type metal-oxide-semiconductor transistor 1026 has a first terminal for receiving the first voltage V1, a second terminal coupled to the second terminal of the first P-type metal-oxide-semiconductor transistor 1024, and a third terminal coupled to the second terminal of the second P-type metal-oxide-semiconductor transistor 1026. Each first N-type metal-oxide-semiconductor transistor of the first N-type metal-oxide-semiconductor transistors 10281-1028M has a first terminal coupled to the third terminal of the first P-type metal-oxide-semiconductor transistor 1024, a second terminal acting as a first input terminal of M first input terminals of the amplifier 102 for receiving an internal voltage, and a third terminal coupled to the first terminal of the current source 1022. For example, the first N-type metal-oxide-semiconductor transistor 10281 has a first terminal coupled to the third terminal of the first P-type metal-oxide-semiconductor transistor 1024, a second terminal acting as a first input terminal of the M first input terminals of the amplifier 102 for receiving an internal voltage VINT1, and a third terminal coupled to the first terminal of the current source 1022, where the internal voltage VINT1 is between the first voltage V1 and the second voltage V2 after processed. The second N-type metal-oxide-semiconductor transistor 1030 has a first terminal coupled to the third terminal of the second P-type metal-oxide-semiconductor transistor 1026, a second terminal coupled to the third terminal of the first metal-oxide-semiconductor transistor 104 for acting as a second input terminal of the amplifier 102, and a third terminal coupled to the first terminal of the current source 1022.

As shown in FIG. 1, the multi-input low dropout regulator 100 further includes a second metal-oxide-semiconductor transistor 110 and an OR gate 112, where the second metal-oxide-semiconductor transistor 110 is a P-type metal-oxide-semiconductor transistor. The second metal-oxide-semiconductor transistor 110 has a first terminal for receiving the first voltage V1, a second terminal coupled to the control terminal of the current source 1022, and a third terminal coupled to the second terminal of the first metal-oxide-semiconductor transistor 104. The OR gate 112 has M enable input terminals, and an output terminal coupled to the second terminal of the second metal-oxide-semiconductor transistor 110, where each enable input terminal of the M enable input terminals is used for receiving a corresponding internal enable signal.

As shown in FIG. 1, when internal enable signals EMVINT1-EMVINTM received by the M enable input terminals of the OR gate 112 are low, a voltage of the output terminal of the OR gate 112 is low, resulting in the second metal-oxide-semiconductor transistor 110 being turned on, the current source 1022 being turned off, and a voltage of a node A is equal to the first voltage V1 (high). Because the voltage of the node A is equal to the first voltage V1, the first metal-oxide-semiconductor transistor 104 is turned off. Because the current source 1022 is turned off, the amplifier 102 is disabled. Thus, because the first metal-oxide-semiconductor transistor 104 is turned off and the amplifier 102 is disabled, the monitor pad 108 is floating. That is to say, the monitor pad 108 does not output any internal voltage of internal voltages VINT1-VINTM, where the internal voltages VINT1-VINTM are between the first voltage V1 and the second voltage V2 after processed.

As shown in FIG. 1, when one internal enable signal (e.g. EMVINT1) of the internal enable signals EMVINT1-EMVINTM received by the M enable input terminals of the OR gate 112 is high (meanwhile, the second terminal of the first N-type metal-oxide-semiconductor transistor 10281 corresponding to the internal enable signal EMVINT1 receives the internal voltage VINT1), the voltage of the output terminal of the OR gate 112 is high, resulting in the second metal-oxide-semiconductor transistor 110 is turned off, the current source 1022 is turned on (that is, the amplifier 102 is enabled), and the voltage of the node A (between the first voltage V1 and the second voltage V2) is equal to a voltage of the third terminal of the first P-type metal-oxide-semiconductor transistor 1024 (that is, a voltage of the output terminal of the amplifier 102). Because the voltage of the node A is equal to the voltage of the third terminal of the first P-type metal-oxide-semiconductor transistor 1024, the first metal-oxide-semiconductor transistor 104 is turned on. Because the current source 1022 is turned on, the amplifier 102 is enabled. Thus, because the first metal-oxide-semiconductor transistor 104 is turned on and the amplifier 102 is enabled, a voltage of the second terminal of the second N-type metal-oxide-semiconductor transistor 1030 is equal to a voltage of the second terminal of the first N-type metal-oxide-semiconductor transistor 10281 (the internal voltage VINT1). That is to say, a voltage of the monitor pad 108 is equal to the internal voltage VINT1. Therefore, the monitor pad 108 can output the internal voltage VINT1.

Figure 2:
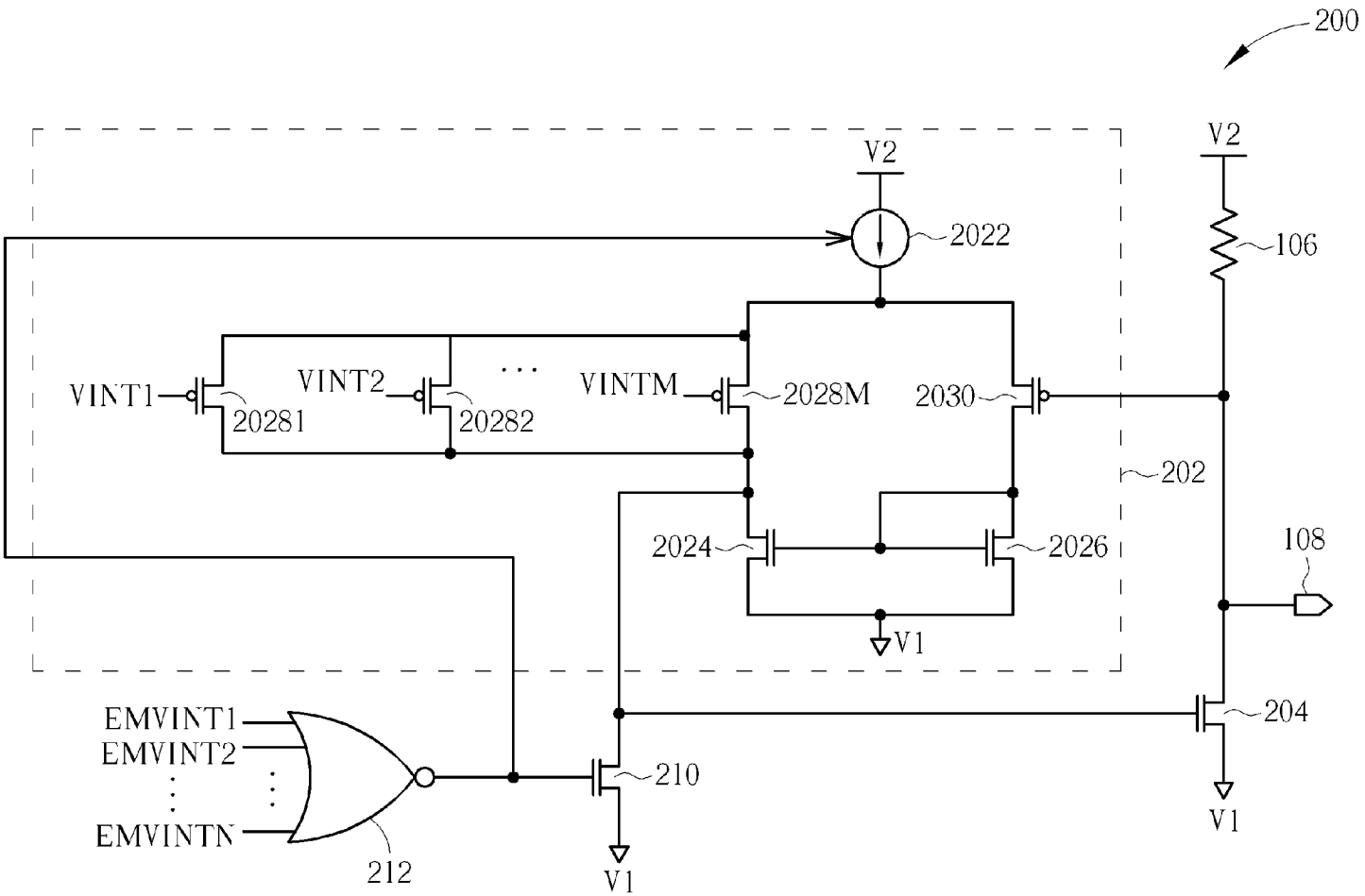
FIG. 2 is a diagram illustrating a multi-input low dropout regulator according to another embodiment.

Please refer to FIG. 2. FIG. 2 is a diagram illustrating a multi-input low dropout regulator 200 according to another embodiment. The multi-input low dropout regulator 200 includes an amplifier 202, a first metal-oxide-semiconductor transistor 204, and a resistor 106, where the first metal-oxide-semiconductor transistor 204 is an N-type metal-oxide-semiconductor transistor. As shown in FIG. 2, the amplifier 202 includes a current source 2022, a first N-type metal-oxide-semiconductor transistor 2024, a second N-type metal-oxide-semiconductor transistor 2026, M first P-type metal-oxide-semiconductor transistors 20281-2028M, and a second P-type metal-oxide-semiconductor transistor 2030, where M is a positive integer. The first metal-oxide-semiconductor transistor 204 has a first terminal for receiving a first voltage V1, a second terminal coupled to a third terminal of the first N-type metal-oxide-semiconductor transistor 2024, and a third terminal coupled to a second terminal of the second P-type metal-oxide-semiconductor transistor 2030, where the first voltage V1 is a low voltage. The resistor 106 has a first terminal coupled to the third terminal of the first metal-oxide-semiconductor transistor 204, and a second terminal is used for receiving a second voltage V2, where the second voltage V2 is a high voltage. In addition, the third terminal of the first metal-oxide-semiconductor transistor 204 is further used for coupling to the monitor pad 108, where a function of the monitor pad 108 is omitted for simplicity.

As shown in FIG. 2, the current source 2022 has a first terminal, a control terminal, and a third terminal for receiving the second voltage V2. The first N-type metal-oxide-semiconductor transistor 2024 has a first terminal for receiving the first voltage V1, a second terminal, and a third terminal coupled to the second terminal of the first metal-oxide-semiconductor transistor 204, where the third terminal of the first N-type metal-oxide-semiconductor transistor 2024 is used for acting as an output terminal of the amplifier 202. The second N-type metal-oxide-semiconductor transistor 2026 has a first terminal for receiving the first voltage V1, a second terminal coupled to the second terminal of the first N-type metal-oxide-semiconductor transistor 2024, and a third terminal coupled to the second terminal of the second N-type metal-oxide-semiconductor transistor 2026. Each first P-type metal-oxide-semiconductor transistor of the first P-type metal-oxide-semiconductor transistors 20281-2028M has a first terminal coupled to the third terminal of the first N-type metal-oxide-semiconductor transistor 2024, a second terminal acting as a first input terminal of M first input terminals of the amplifier 202 for receiving an internal voltage, and a third terminal coupled to the first terminal of the current source 2022. For example, the first P-type metal-oxide-semiconductor transistor 20281 has a first terminal coupled to the third terminal of the first N-type metal-oxide-semiconductor transistor 2024, a second terminal acting as a first input terminal of the M first input terminals of the amplifier 202 for receiving an internal voltage VINT1, and a third terminal coupled to the first terminal of the current source 2022, where the internal voltage VINT1 is between the first voltage V1 and the second voltage V2 after processed. The second P-type metal-oxide-semiconductor transistor 2030 has a first terminal coupled to the third terminal of the second N-type metal-oxide-semiconductor transistor 2026, a second terminal coupled to the third terminal of the first metal-oxide-semiconductor transistor 204 for acting as a second input terminal of the amplifier 202, and a third terminal coupled to the first terminal of the current source 2022.

As shown in FIG. 2, the multi-input low dropout regulator 200 further includes a second metal-oxide-semiconductor transistor 210 and a NOR gate 212, where the second metal-oxide-semiconductor transistor 210 is an N-type metal-oxide-semiconductor transistor. The second metal-oxide-semiconductor transistor 210 has a first terminal for receiving the first voltage V1, a second terminal coupled to the control terminal of the current source 2022, and a third terminal coupled to the second terminal of the first metal-oxide-semiconductor transistor 204. The NOR gate 212 has M enable input terminals, and an output terminal coupled to the second terminal of the second metal-oxide-semiconductor transistor 210, where each enable input terminal of the M enable input terminals of the NOR gate 212 is used for receiving a corresponding internal enable signal.

In addition, subsequent operational principles of the amplifier 202, the first metal-oxide-semiconductor transistor 204, the second metal-oxide-semiconductor transistor 210, and the NOR gate 212 of the multi-input low dropout regulator 200 are the same as those of the amplifier 102, the first metal-oxide-semiconductor transistor 104, the second metal-oxide-semiconductor transistor 110, and the OR gate 112 of the multi-input low dropout regulator 100, so further description thereof is omitted for simplicity.

Figure 3:
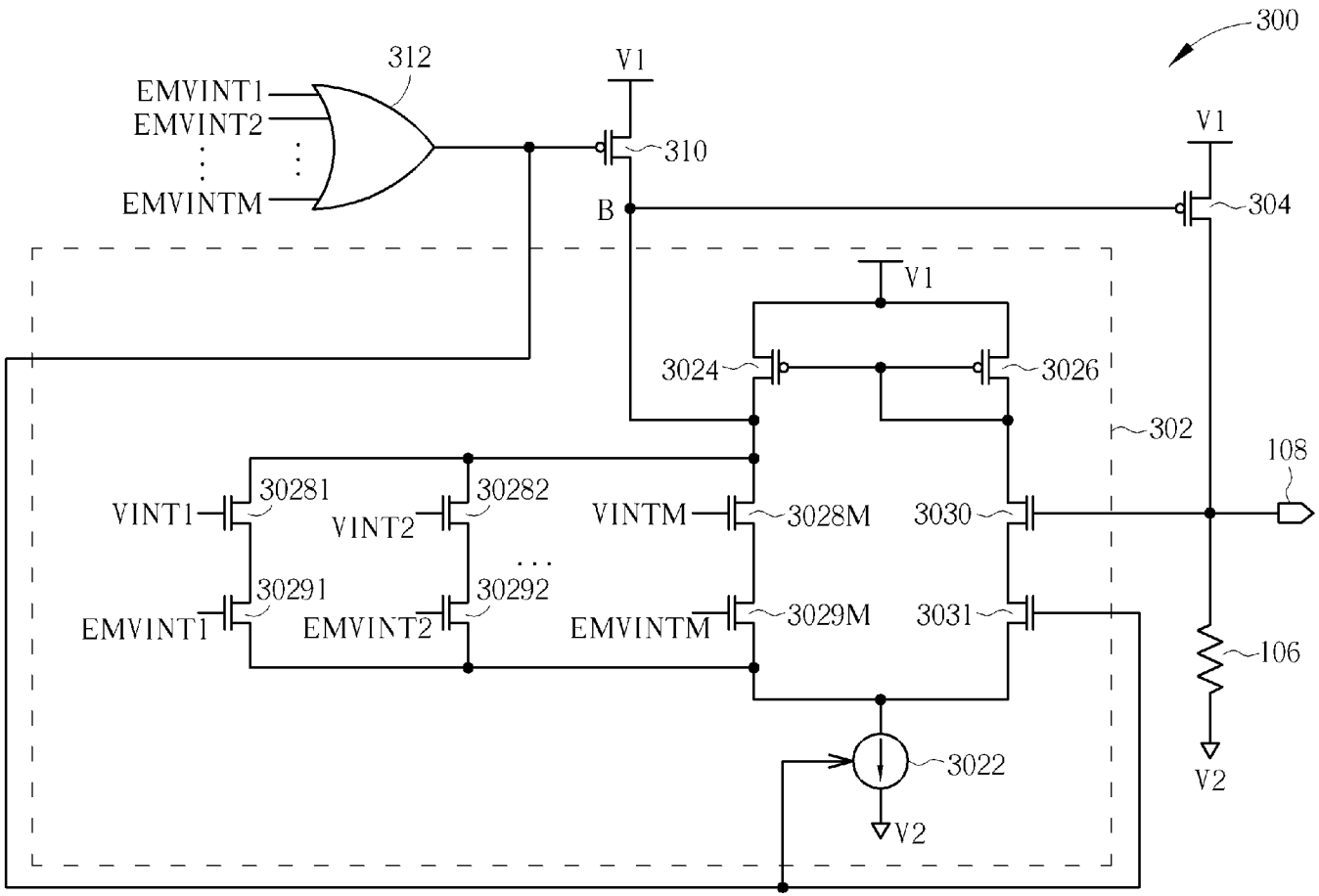
FIG. 3 is a diagram illustrating a multi-input low dropout regulator according to another embodiment.

Please refer to FIG. 3. FIG. 3 is a diagram illustrating a multi-input low dropout regulator 300 according to another embodiment. The multi-input low dropout regulator 300 includes an amplifier 302, a first metal-oxide-semiconductor transistor 304, and a resistor 106, where the first metal-oxide-semiconductor transistor 304 is a P-type metal-oxide-semiconductor transistor. As shown in FIG. 3, the amplifier 302 includes a current source 3022, a first P-type metal-oxide-semiconductor transistor 3024, a second P-type metal-oxide-semiconductor transistor 3026, M first N-type metal-oxide-semiconductor transistors 30281-3028M, M first enable N-type metal-oxide-semiconductor transistors 30291-3029M, a second N-type metal-oxide-semiconductor transistor 3030, and a second enable N-type metal-oxide-semiconductor transistor 3031, where M is a positive integer. The first metal-oxide-semiconductor transistor 304 has a first terminal for receiving a first voltage V1, a second terminal coupled to a third terminal of the first P-type metal-oxide-semiconductor transistor 3024, and a third terminal coupled to a second terminal of the second N-type metal-oxide-semiconductor transistor 3030, where the first voltage V1 is a high voltage. The resistor 106 has a first terminal coupled to the third terminal of the first metal-oxide-semiconductor transistor 304, and a second terminal for receiving a second voltage V2, where the second voltage V2 is a low voltage. In addition, the third terminal of the first metal-oxide-semiconductor transistor 304 is further used for coupling to the monitor pad 108, where the function of the monitor pad 108 is omitted for simplicity.

As shown in FIG. 3, the current source 3022 has a first terminal, a control terminal, and a third terminal for receiving the second voltage V2. The first P-type metal-oxide-semiconductor transistor 3024 has a first terminal for receiving the first voltage V1, a second terminal, and a third terminal coupled to the second terminal of the first metal-oxide-semiconductor transistor 304, where the third terminal of the first P-type metal-oxide-semiconductor transistor 3024 is used for acting as an output terminal of the amplifier 302. The second P-type metal-oxide-semiconductor transistor 3026 has a first terminal for receiving the first voltage V1, a second terminal coupled to the second terminal of the first P-type metal-oxide-semiconductor transistor 3024, and a third terminal coupled to the second terminal of the second P-type metal-oxide-semiconductor transistor 3026. Each first N-type metal-oxide-semiconductor transistor of the first N-type metal-oxide-semiconductor transistors 30281-3028M has a first terminal coupled to the third terminal of the first P-type metal-oxide-semiconductor transistor 3024, a second terminal acting as a first input terminal of M first input terminals of the amplifier 302 for receiving an internal voltage, and a third terminal. Each first enable N-type metal-oxide-semiconductor transistor of the first enable N-type metal-oxide-semiconductor transistors 30291-3029M has a first terminal coupled to a third terminal of a corresponding first N-type metal-oxide-semiconductor transistor, a second terminal acting as a first enable input terminal of M first enable input terminals of the amplifier 302 for receiving a corresponding internal enable signal, and a third terminal coupled to the first terminal of the current source 3022. For example, the first N-type metal-oxide-semiconductor transistor 30281 has a first terminal coupled to the third terminal of the first P-type metal-oxide-semiconductor transistor 3024, a second terminal acting as a first input terminal of the M first input terminals of the amplifier 302 for receiving an internal voltage VINT1, and a third terminal; and the first enable N-type metal-oxide-semiconductor transistor 30291 has a first terminal coupled to the third terminal of the first N-type metal-oxide-semiconductor transistor 30281, a second terminal acting as a first enable input terminal of the M first enable input terminals of the amplifier 302 for receiving an internal enable signal EMVINT1, and a third terminal coupled to the first terminal of the current source 3022, where the internal voltage VINT1 and the internal enable signal EMVINT1 are between the first voltage V1 and the second voltage V2 after processed. The second N-type metal-oxide-semiconductor transistor 3030 has a first terminal coupled to the third terminal of the second P-type metal-oxide-semiconductor transistor 3026, a second terminal coupled to the third terminal of the first metal-oxide-semiconductor transistor 304 for acting as a second input terminal of the amplifier 302, and a third terminal. The second enable N-type metal-oxide-semiconductor transistor 3031 has a first terminal coupled to the third terminal of the second P-type metal-oxide-semiconductor transistor 3030, a second terminal acting as a second enable input terminal of the amplifier 302, and a third terminal coupled to the first terminal of the current source 3022.

As shown in FIG. 3, the multi-input low dropout regulator 300 further includes a second metal-oxide-semiconductor transistor 310 and an OR gate 312, where the second metal-oxide-semiconductor transistor 310 is a P-type metal-oxide-semiconductor transistor. The second metal-oxide-semiconductor transistor 310 has a first terminal for receiving the first voltage V1, a second terminal coupled to the control terminal of the current source 3022 and the second terminal of the second enable N-type metal-oxide-semiconductor transistor 3031, and a third terminal coupled to the second terminal of the first metal-oxide-semiconductor transistor 304. The OR gate 312 has M enable input terminals, and an output terminal coupled to the second terminal of the second metal-oxide-semiconductor transistor 310, where each enable input terminal of the M enable input terminals of the OR gate 312 is coupled to a second terminal of a corresponding first enable N-type metal-oxide-semiconductor transistor.

As shown in FIG. 3, when internal enable signals EMVINT1-EMVINTM received by the M enable input terminals of the OR gate 312 are low, the first enable N-type metal-oxide-semiconductor transistors 30291-3029M are turned off and a voltage of the output terminal of the OR gate 312 is low. Because the voltage of the output terminal of the OR gate 312 is low, the second metal-oxide-semiconductor transistor 310 is turned on, the current source 3022 is turned off, and a voltage of a node B is equal to the first voltage V1 (high). Because the voltage of the node B is equal to the first voltage V1, the first metal-oxide-semiconductor transistor 304 is turned off. Because the current source 3022 is turned off, the amplifier 302 is disabled. Thus, because the first metal-oxide-semiconductor transistor 304 is turned off and the amplifier 302 is disabled, the monitor pad 108 is floating. That is to say, the monitor pad 108 does not output any internal voltage of internal voltages VINT1-VINTM, where the internal voltages VINT1-VINTM are between the first voltage V1 and the second voltage V2 after processed.

As shown in FIG. 3, when one internal enable signal (e.g. EMVINT1) of internal enable signals EMVINT1-EMVINTM received by the M enable input terminals of the OR gate 312 is high (meanwhile, the second terminal of the first N-type metal-oxide-semiconductor transistor 30281 corresponding to the internal enable signal EMVINT1 receives the internal voltage VINT1), the voltage of the output terminal of the OR gate 312 is high and the first enable N-type metal-oxide-semiconductor transistor 30291 is turned on (other first enable N-type metal-oxide-semiconductor transistors 30292-3029M are still turned off due to the corresponding internal enable signals EMVINT2-EMVINTM being low). Because the voltage of the output terminal of the OR gate 312 is high, the second metal-oxide-semiconductor transistor 310 is turned off, the current source 3022 is turned on (that is, the amplifier 302 is enabled), and the voltage of the node B (between the first voltage V1 and the second voltage V2) is equal to a voltage of the third terminal of the first P-type metal-oxide-semiconductor transistor 3024 (that is, a voltage of the output terminal of the amplifier 302). Because the voltage of the node B is equal to the voltage of the third terminal of the first P-type metal-oxide-semiconductor transistor 3024, the first metal-oxide-semiconductor transistor 304 is turned on. Because the current source 3022 is turned on, the amplifier 302 is enabled. Thus, because the first metal-oxide-semiconductor transistor 304 is turned on and the amplifier 302 is enabled, a voltage of the second terminal of the second P-type metal-oxide-semiconductor transistor 3030 is equal to a voltage of the second terminal of the first N-type metal-oxide-semiconductor transistor 30281 (the internal voltage VINT1). That is to say, a voltage of the monitor pad 108 is equal to the internal voltage VINT1. Therefore, the monitor pad 108 can output the internal voltage VINT1.

Figure 4:
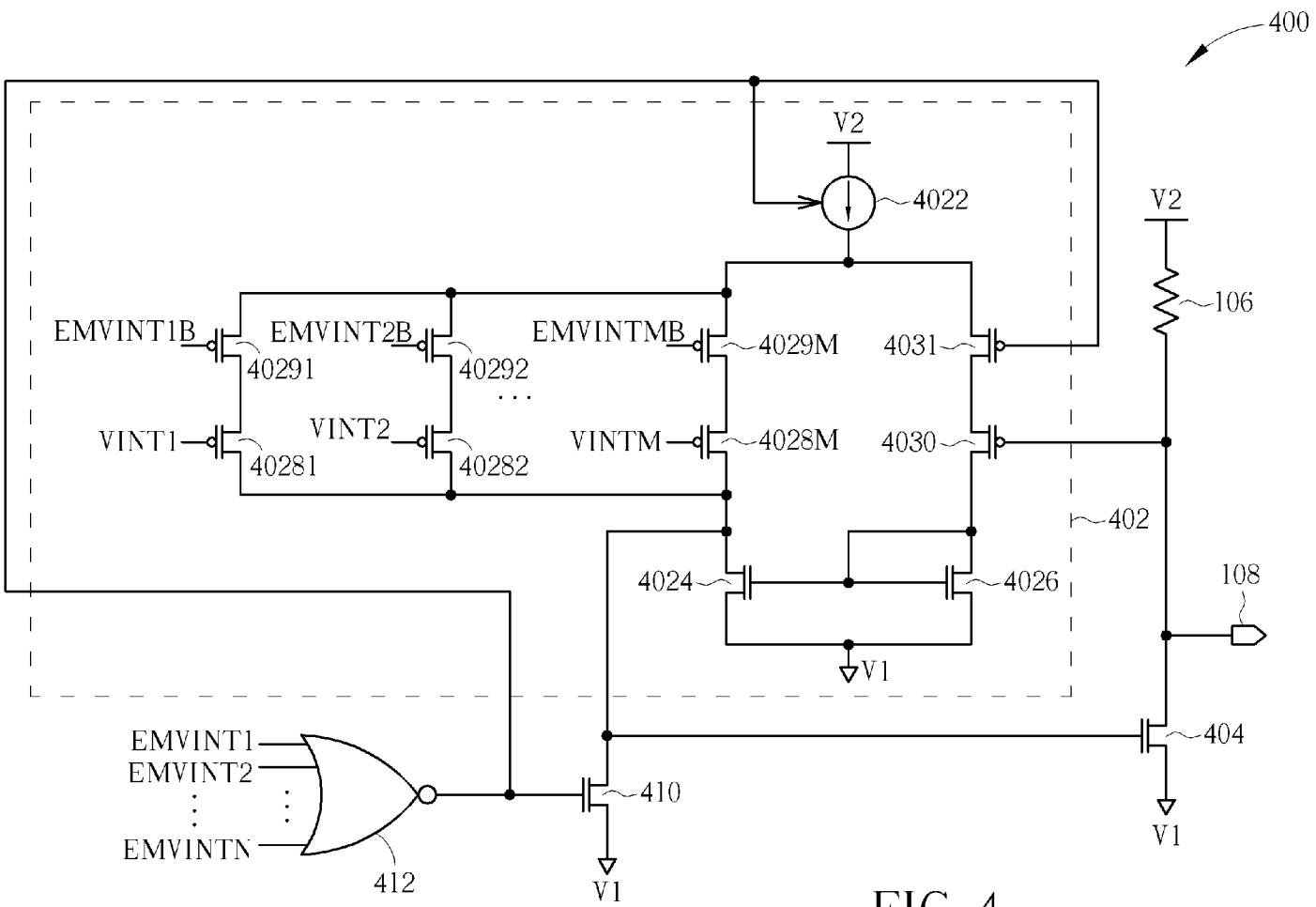
FIG. 4 is a diagram illustrating a multi-input low dropout regulator according to another embodiment.

Please refer to FIG. 4. FIG. 4 is a diagram illustrating a multi-input low dropout regulator 400 according to another embodiment. The multi-input low dropout regulator 400 includes an amplifier 402, a first metal-oxide-semiconductor transistor 404, and a resistor 106, where the first metal-oxide-semiconductor transistor 404 is an N-type metal-oxide-semiconductor transistor. As shown in FIG. 4, the amplifier 402 includes a current source 4022, a first N-type metal-oxide-semiconductor transistor 4024, a second P-type metal-oxide-semiconductor transistor 4026, M first P-type metal-oxide-semiconductor transistors 40281-4028M, M first enable P-type metal-oxide-semiconductor transistors 40291-4029M, a second P-type metal-oxide-semiconductor transistor 4030, and a second enable P-type metal-oxide-semiconductor transistor 4031, where M is a positive integer. The first metal-oxide-semiconductor transistor 404 has a first terminal for receiving a first voltage V1, a second terminal coupled to a third terminal of the first N-type metal-oxide-semiconductor transistor 4024, and a third terminal coupled to a second terminal of the second P-type metal-oxide-semiconductor transistor 4030, where the first voltage V1 is a low voltage. The resistor 106 has a first terminal coupled to the third terminal of the first metal-oxide-semiconductor transistor 404, and a second terminal for receiving a second voltage V2, where the second voltage V2 is a high voltage. In addition, the third terminal of the first metal-oxide-semiconductor transistor 404 is further used for coupling to the monitor pad 108, where the function of the monitor pad 108 is omitted for simplicity.

As shown in FIG. 4, the current source 4022 has a first terminal, a control terminal, and a third terminal for receiving the second voltage V2. The first N-type metal-oxide-semiconductor transistor 4024 has a first terminal for receiving the first voltage V1, a second terminal, and a third terminal coupled to the second terminal of the first metal-oxide-semiconductor transistor 404, where the third terminal of the first N-type metal-oxide-semiconductor transistor 4024 is used for acting as an output terminal of the amplifier 402. The second N-type metal-oxide-semiconductor transistor 4026 has a first terminal for receiving the first voltage V1, a second terminal coupled to the second terminal of the first N-type metal-oxide-semiconductor transistor 4024, and a third terminal coupled to the second terminal of the second N-type metal-oxide-semiconductor transistor 4026. Each first P-type metal-oxide-semiconductor transistor of the first P-type metal-oxide-semiconductor transistors 40281-4028M has a first terminal coupled to the third terminal of the first N-type metal-oxide-semiconductor transistor 4024, a second terminal acting as a first input terminal of M first input terminals of the amplifier 402 for receiving an internal voltage, and a third terminal. Each first enable P-type metal-oxide-semiconductor transistor of the first enable P-type metal-oxide-semiconductor transistors 40291-4029M has a first terminal coupled to a third terminal of a corresponding first P-type metal-oxide-semiconductor transistor, a second terminal acting as a first enable input terminal of M first enable input terminals of the amplifier 402 for receiving a corresponding inverse internal enable signal, and a third terminal coupled to the first terminal of the current source 4022. For example, the first P-type metal-oxide-semiconductor transistor 40281 has a first terminal coupled to the third terminal of the first N-type metal-oxide-semiconductor transistor 4024, a second terminal acting as a first input terminal of the M first input terminals of the amplifier 402 for receiving an internal voltage VINT1, and a third terminal; and the first enable P-type metal-oxide-semiconductor transistor 40291 has a first terminal coupled to the third terminal of the first P-type metal-oxide-semiconductor transistor 40281, a second terminal acting as a first enable input terminal of the M first enable input terminals of the amplifier 402 for receiving an inverse internal enable signal EMVINT1B, and a third terminal coupled to the first terminal of the current source 4022, where the internal voltage VINT1 and the inverse internal enable signal EMVINT1B are between the first voltage V1 and the second voltage V2 after processed. The second P-type metal-oxide-semiconductor transistor 4030 has a first terminal coupled to the third terminal of the second N-type metal-oxide-semiconductor transistor 4026, a second terminal coupled to the third terminal of the first metal-oxide-semiconductor transistor 404 for acting as a second input terminal of the amplifier 402, and a third terminal. The second enable P-type metal-oxide-semiconductor transistor 4031 has a first terminal coupled to the third terminal of the second P-type metal-oxide-semiconductor transistor 4030, a second terminal for acting as a second enable input terminal of the amplifier 402, and a third terminal coupled to the first terminal of the current source 4022.

As shown in FIG. 4, the multi-input low dropout regulator 400 further includes a second metal-oxide-semiconductor transistor 410 and a NOR gate 412, where the second metal-oxide-semiconductor transistor 410 is an N-type metal-oxide-semiconductor transistor. The second metal-oxide-semiconductor transistor 410 has a first terminal for receiving the first voltage V1, a second terminal coupled to the control terminal of the current source 4022 and the second terminal of the second enable P-type metal-oxide-semiconductor transistor 4031, and a third terminal coupled to the second terminal of the first metal-oxide-semiconductor transistor 404. The NOR gate 412 has M enable input terminals, and an output terminal coupled to the second terminal of the second metal-oxide-semiconductor transistor 410, where each enable input terminal of the M enable input terminals of the NOR gate 412 is used for receiving a corresponding internal enable signal.

In addition, subsequent operational principles of the amplifier 402, the first metal-oxide-semiconductor transistor 404, the second metal-oxide-semiconductor transistor 410, and the NOR gate 412 of the multi-input low dropout regulator 400 are the same as those of the amplifier 302, the first metal-oxide-semiconductor transistor 304, the second metal-oxide-semiconductor transistor 310, and the OR gate 312 of the multi-input low dropout regulator 300, so further description thereof is omitted for simplicity.

To sum up, the multi-input low dropout regulator utilizes the amplifier with the plurality of first input terminals and the monitor pad to monitor a plurality of internal voltage of an integrated circuit. Thus, compared to the prior art, because the present invention utilizes one amplifier and one monitor pad to monitor the plurality of internal voltage of the integrated circuit, the present invention can significantly reduce a chip area of the integrated circuit.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A multi-input low dropout regulator, comprising:

an amplifier having a plurality of first input terminals, a second input terminal, and an output terminal, wherein each first input terminal of the plurality of first input terminals is used for receiving corresponding internal voltage respectively, and is not connected to another first input terminal of the plurality of first input terminals;

a first metal-oxide-semiconductor transistor having a first terminal for receiving a first voltage, a second terminal coupled to the output terminal of the amplifier, and a third terminal coupled to the second input terminal of the amplifier; and a resistor having a first terminal coupled to the third terminal of the first metal-oxide-semiconductor transistor, and a second terminal for receiving a second voltage;

wherein a voltage of the first input terminal of the plurality of first input terminals of the amplifier is equal to a voltage of the second input terminal of the amplifier when the amplifier operates normally, and the third terminal of the first metal-oxide-semiconductor transistor is further used for coupling to a monitor pad, and the monitor pad is used for outputting the corresponding internal voltage.

2. The multi-input low dropout regulator of claim 1, wherein the amplifier comprises:

a current source having a first terminal, a control terminal, and a third terminal for receiving the second voltage;

a first P-type metal-oxide-semiconductor transistor having a first terminal for receiving the first voltage, a second terminal, and a third terminal coupled to the second terminal of the first metal-oxide-semiconductor transistor for acting as the output terminal of the amplifier;

a second P-type metal-oxide-semiconductor transistor having a first terminal for receiving the first voltage, a second terminal coupled to the second terminal of the first P-type metal-oxide-semiconductor transistor, and a third terminal coupled to the second terminal of the second P-type metal-oxide-semiconductor transistor;

a plurality of first N-type metal-oxide-semiconductor transistors, wherein each first N-type metal-oxide-semiconductor transistor of the plurality of first N-type metal-oxide-semiconductor transistors has a first terminal coupled to the third terminal of the first P-type metal-oxide-semiconductor transistor, a second terminal for acting as a first input terminal of the plurality of first input terminals of the amplifier, and a third terminal coupled to the first terminal of the current source; and a second N-type metal-oxide-semiconductor transistor having a first terminal coupled to the third terminal of the second P-type metal-oxide-semiconductor transistor, a second terminal coupled to the third terminal of the first metal-oxide-semiconductor transistor for acting as the second input terminal of the amplifier, and a third terminal coupled to the first terminal of the current source.

3. The multi-input low dropout regulator of claim 2, further comprising:

a second metal-oxide-semiconductor transistor having a first terminal for receiving the first voltage, a second terminal coupled to the control terminal of the current source, and a third terminal coupled to the second terminal of the first metal-oxide-semiconductor transistor; and an OR gate having a plurality of enable input terminals, and an output terminal coupled to the second terminal of the second metal-oxide-semiconductor transistor, wherein each enable input terminal of the plurality of enable input terminals is used for receiving a corresponding internal enable signal.

4. The multi-input low dropout regulator of claim 3, wherein the first metal-oxide-semiconductor transistor and the second metal-oxide-semiconductor transistor are P-type metal-oxide-semiconductor transistors.

5. The multi-input low dropout regulator of claim 1, wherein the amplifier comprises:

a current source having a first terminal, a control terminal, and a third terminal for receiving the second voltage;

a first N-type metal-oxide-semiconductor transistor having a first terminal for receiving the first voltage, a second terminal, and a third terminal coupled to the second terminal of the first metal-oxide-semiconductor transistor for acting as the output terminal of the amplifier;

a second N-type metal-oxide-semiconductor transistor having a first terminal for receiving the first voltage, a second terminal coupled to the second terminal of the first N-type metal-oxide-semiconductor transistor, and a third terminal coupled to the second terminal of the second N-type metal-oxide-semiconductor transistor;

a plurality of first P-type metal-oxide-semiconductor transistor, wherein each first P-type metal-oxide-semiconductor transistor of the plurality of first P-type metal-oxide-semiconductor transistor has a first terminal coupled to the third terminal of the first N-type metal-oxide-semiconductor transistor, a second terminal for acting as a first input terminal of the plurality of first input terminals of the amplifier, and a third terminal coupled to the first terminal of the current source; and a second P-type metal-oxide-semiconductor transistor having a first terminal coupled to the third terminal of the second N-type metal-oxide-semiconductor transistor, a second terminal coupled to the third terminal of the first metal-oxide-semiconductor transistor for acting as the second input terminal of the amplifier, and a third terminal coupled to the first terminal of the current source.

6. The multi-input low dropout regulator of claim 5, further comprising:

a second metal-oxide-semiconductor transistor having a first terminal for receiving the first voltage, a second terminal coupled to the control terminal of the current source, and a third terminal coupled to the second terminal of the first metal-oxide-semiconductor transistor; and a NOR gate having a plurality of enable input terminals, and an output terminal coupled to the second terminal of the second metal-oxide-semiconductor transistor, wherein each enable input terminal of the plurality of enable input terminals is used for receiving a corresponding internal enable signal.

7. The multi-input low dropout regulator of claim 6, wherein the first metal-oxide-semiconductor transistor and the second metal-oxide-semiconductor transistor are N-type metal-oxide-semiconductor transistors.

8. A multi-input low dropout regulator, comprising:

an amplifier having a plurality of first input terminals, a plurality of first enable input terminals, a second input terminal, a second enable input terminal, and an output terminal, wherein each first input terminal of the plurality of first input terminals is used for receiving a corresponding internal voltage respectively, and is not connected to another first input terminal of the plurality of first input terminals;

a first metal-oxide-semiconductor transistor having a first terminal for receiving a first voltage, a second terminal coupled to the output terminal of the amplifier, and a third terminal coupled to the second input terminal of the amplifier; and a resistor having a first terminal coupled to the third terminal of the first metal-oxide-semiconductor transistor, and a second terminal for receiving a second voltage;

wherein a voltage of the first input terminal of the plurality of first input terminals of the amplifier is equal to a voltage of the second input terminal of the amplifier when the amplifier operates normally, and the third terminal of the first metal-oxide-semiconductor transistor is further used for coupling to a monitor pad, and the monitor pad is used for outputting the corresponding internal voltage.

9. The multi-input low dropout regulator of claim 8, wherein the amplifier comprises:

a current source having a first terminal, a control terminal, and a third terminal for receiving the second voltage;

a first P-type metal-oxide-semiconductor transistor having a first terminal for receiving the first voltage, a second terminal, and a third terminal coupled to the second terminal of the first metal-oxide-semiconductor transistor for acting as the output terminal of the amplifier;

a second P-type metal-oxide-semiconductor transistor having a first terminal for receiving the first voltage, a second terminal coupled to the second terminal of the first P-type metal-oxide-semiconductor transistor, and a third terminal coupled to the second terminal of the second P-type metal-oxide-semiconductor transistor;

a plurality of first N-type metal-oxide-semiconductor transistors, wherein each first N-type metal-oxide-semiconductor transistor of the plurality of first N-type metal-oxide-semiconductor transistors has a first terminal coupled to the third terminal of the first P-type metal-oxide-semiconductor transistor, a second terminal for acting as a first input terminal of the plurality of first input terminals of the amplifier, and a third terminal;

a plurality of first enable N-type metal-oxide-semiconductor transistors, wherein each first enable N-type metal-oxide-semiconductor transistor of the plurality of first enable N-type metal-oxide-semiconductor transistors has a first terminal coupled to a third terminal of a corresponding first N-type metal-oxide-semiconductor transistor of the plurality of first N-type metal-oxide-semiconductor transistors, a second terminal acting as a first enable input terminal of the plurality of first enable input terminals of the amplifier for receiving a corresponding internal enable signal, and a third terminal coupled to the first terminal of the current source;

a second N-type metal-oxide-semiconductor transistor having a first terminal coupled to the third terminal of the second P-type metal-oxide-semiconductor transistor, a second terminal coupled to the third terminal of the first metal-oxide-semiconductor transistor for acting as the second input terminal of the amplifier, and a third terminal; and a second enable N-type metal-oxide-semiconductor transistor having a first terminal coupled to the third terminal of the second N-type metal-oxide-semiconductor transistor, a second terminal for acting as the second enable input terminal of the amplifier, and a third terminal coupled to the first terminal of the current source.

10. The multi-input low dropout regulator of claim 9, further comprising:

a second metal-oxide-semiconductor transistor having a first terminal for receiving the first voltage, a second terminal coupled to the control terminal of the current source and the second terminal of the second enable N-type metal-oxide-semiconductor transistor, and a third terminal coupled to the second terminal of the first metal-oxide-semiconductor transistor; and an OR gate having a plurality of enable input terminals, and an output terminal coupled to the second terminal of the second metal-oxide-semiconductor transistor, wherein each enable input terminal of the plurality of enable input terminals is coupled to a second terminal of a corresponding first enable N-type metal-oxide-semiconductor transistor of the plurality of first enable N-type metal-oxide-semiconductor transistors.

11. The multi-input low dropout regulator of claim 10, wherein the first metal-oxide-semiconductor transistor and the second metal-oxide-semiconductor transistor are P-type metal-oxide-semiconductor transistors.

12. The multi-input low dropout regulator of claim 8, wherein the amplifier comprises:

a current source having a first terminal, a control terminal, and a third terminal for receiving the second voltage;

a first N-type metal-oxide-semiconductor transistor having a first terminal for receiving the first voltage, a second terminal, and a third terminal coupled to the second terminal of the first metal-oxide-semiconductor transistor for acting as the output terminal of the amplifier;

a second N-type metal-oxide-semiconductor transistor having a first terminal for receiving the first voltage, a second terminal coupled to the second terminal of the first N-type metal-oxide-semiconductor transistor, and a third terminal coupled to the second terminal of the second N-type metal-oxide-semiconductor transistor;

a plurality of first P-type metal-oxide-semiconductor transistors, wherein each first P-type metal-oxide-semiconductor transistor of the plurality of first P-type metal-oxide-semiconductor transistors has a first terminal coupled to the third terminal of the first N-type metal-oxide-semiconductor transistor, a second terminal for acting as a first input terminal of the plurality of first input terminals of the amplifier, and a third terminal;

a plurality of first enable P-type metal-oxide-semiconductor transistor, wherein each first enable P-type metal-oxide-semiconductor transistor of the plurality of first enable P-type metal-oxide-semiconductor transistors has a first terminal coupled to a third terminal of a corresponding first P-type metal-oxide-semiconductor transistor of the plurality of first P-type metal-oxide-semiconductor transistors, a second terminal acting as a first enable input terminal of the plurality of first enable input terminals for receiving a corresponding inverse internal enable signal, and a third terminal coupled to the first terminal of the current source;

a second P-type metal-oxide-semiconductor transistor having a first terminal coupled to the third terminal of the second N-type metal-oxide-semiconductor transistor, a second terminal coupled to the third terminal of the first metal-oxide-semiconductor transistor for acting as the second input terminal of the amplifier, and a third terminal; and a second enable P-type metal-oxide-semiconductor transistor having a first terminal coupled to the third terminal of the second P-type metal-oxide-semiconductor transistor, a second terminal for acting as the second enable input terminal of the amplifier, and a third terminal coupled to the first terminal of the current source.

13. The multi-input low dropout regulator of claim 12, further comprising:

a second metal-oxide-semiconductor transistor having a first terminal for receiving the first voltage, a second terminal coupled to the control terminal of the current source and the second terminal of the second enable P-type metal-oxide-semiconductor transistor, and a third terminal coupled to the second terminal of the first metal-oxide-semiconductor transistor; and a NOR gate having a plurality of enable input terminals, and an output terminal coupled to the second terminal of the second metal-oxide-semiconductor transistor, wherein each enable input terminal of the plurality of enable input terminals is used for receiving a corresponding internal enable signal.

14. The multi-input low dropout regulator of claim 13, wherein the first metal-oxide-semiconductor transistor and the second metal-oxide-semiconductor transistor are N-type metal-oxide-semiconductor transistors.

* * * * *